US007347393B2

(12) United States Patent
Kang

(10) Patent No.: US 7,347,393 B2
(45) Date of Patent: Mar. 25, 2008

(54) NANO GRINDING MILL (DRIED TYPE)

(75) Inventor: Dae Il Kang, Buk-gu (KR)

(73) Assignee: Techworld Co., Ltd. (KR)

( * ) Notice: Subject to any disclaimer, the term of this patent is extended or adjusted under 35 U.S.C. 154(b) by 69 days.

(21) Appl. No.: 10/524,171

(22) PCT Filed: Aug. 11, 2003

(86) PCT No.: PCT/KR03/01608

§ 371 (c)(1),
(2), (4) Date: Mar. 14, 2006

(87) PCT Pub. No.: WO2004/014557

PCT Pub. Date: Feb. 19, 2004

(65) Prior Publication Data

US 2006/0144978 A1 Jul. 6, 2006

(30) Foreign Application Priority Data

Aug. 12, 2002 (KR) ..... 10-2002-0050654

(51) Int. Cl.
*B02C 19/00* (2006.01)

(52) U.S. Cl. ..... 241/252; 241/253

(58) Field of Classification Search ..... 241/212, 241/245, 252, 253, 257.1, 258
See application file for complete search history.

(56) References Cited

U.S. PATENT DOCUMENTS

| | | | | |
|---|---|---|---|---|
| 4,523,721 A | | 6/1985 | Maliszewski | |
| 4,714,202 A | | 12/1987 | Shulof | |
| 4,723,718 A | * | 2/1988 | LaPointe | 241/235 |
| 4,863,109 A | * | 9/1989 | Standring | 241/252 |

FOREIGN PATENT DOCUMENTS

| | | | |
|---|---|---|---|
| KR | 84-0006917 | A | 12/1984 |
| KR | 94-0005318 | A | 3/1994 |
| KR | 95-0016852 | A | 7/1995 |
| KR | 96-0013464 | A | 5/1996 |
| KR | 2001-0077393 | A | 8/2001 |

* cited by examiner

*Primary Examiner*—Mark Rosenbaum
(74) *Attorney, Agent, or Firm*—McKee, Voorhees & Sease, P.L.C.

(57) ABSTRACT

Disclosed is a nano grinding mill including a lower turntable with a disc plate mounted on the lower portion thereof, and upper and intermediate plates disposed above the lower turntable, each of the upper and intermediate plates having several tens to several thousands of pressure grinding rods mounted thereon, the upper plate being adapted to fix the pressure grinding rods and the intermediate plate being adapted to eccentrically rotate the pressure grinding rods.

3 Claims, 12 Drawing Sheets

NANO GRINDING MILL (DRIED TYPE)

TECHNICAL FIELD

The present invention relates to a nano grinding mill that is capable of grinding various kinds of non-metal or metal minerals such as calcium carbonate, silica, and alumina, leaves of green tea, sulfur, and so on to extremely fine sizes in a range between 0.1 μm and 1 μm in a dried manner.

BACKGROUND ART

There have been conventionally proposed various kinds of grinding mills such as a ball grinding mill, a vibration grinding mill, a roller grinding mill, a jet grinding mill, and the like. In case of the jet grinding mill, especially, it could reach the fineness of the material to be finely ground into a size of a range of 5 μm. However, there haven't been proposed any grinding mill having the result with the fineness in a range between 0.1 μm and 1 μm in a dried manner. By the way, this has been achieved depending upon the wet grinding manner that has some disadvantages of producing waste water, raising process costs, making the process complicated, and causing the components of the material to be ground to be varied.

Only in case of special works, thus, nano-sized particles that are produced in the wet grinding manner, at the expense of substantially high manufacturing costs, have been used, and even though the excellence of the nano-sized particles is noticed, the use of the particles is being limited because of their high production costs.

DISCLOSURE OF INVENTION

Accordingly, the present invention has been made in view of the above-described problems, and it is an object of the present invention to provide a nano grinding mill that is capable of grinding various kinds of non-metal or metal minerals such as calcium carbonate, silica, and alumina, leaves of green tea, sulfur, and so on to extremely fine sizes in a range between 0.1 μm and 1 μm in a dried manner.

To achieve the above object, according to the present invention, there is provided a nano grinding mill that includes: a lower turntable with a disc plate mounted on the lower portion thereof; and upper and intermediate plates disposed above the lower turntable, each of the upper and intermediate plates having several tens to several thousands of pressure grinding rods mounted thereon, the upper plate being adapted to fix the pressure grinding rods and the intermediate plate being adapted to eccentrically rotate the pressure grinding rods.

In more detail, the principles of this invention are based on motion mechanism of a plurality of pressure grinding rods (e.g., several tens to several thousands of pressure grinding rods).

That is to say, the several tens to several thousands of pressure grinding rods are mounted at the top end of a lower disc turntable in such a manner that their points are fixed to an upper plate, while a predetermined pressure (about 0.5 to 5 kg) is being applied, and their middle portions are mounted on an intermediate plate by use of self-aligning bearings or rubber O rings, whereby when a driving motor that is connected by use of a belt or a chain to an eccentric driving shaft is activated, the several tens to several thousands of pressure grinding rods are individually rotated under the application of the predetermined pressure and at the same time, the lower turntable is rotated in a clockwise or counterclockwise direction.

BRIEF DESCRIPTION OF THE DRAWINGS

Further objects and advantages of the invention can be more fully understood from the following detailed description taken in conjunction with the accompanying drawings, in which.

BEST MODE FOR CARRYING OUT THE INVENTION

Now, an explanation of the preferred embodiment of the present invention will be in detail given.

Figure 1:
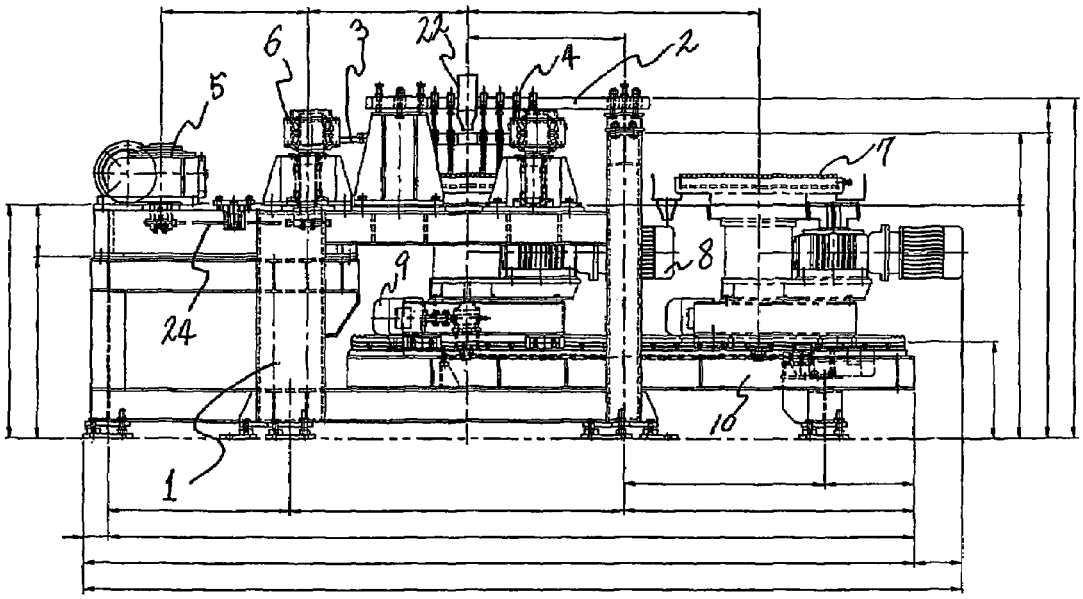
FIG. 1 is a front view of a nano grinding mill according to the present invention.
Figure 2:
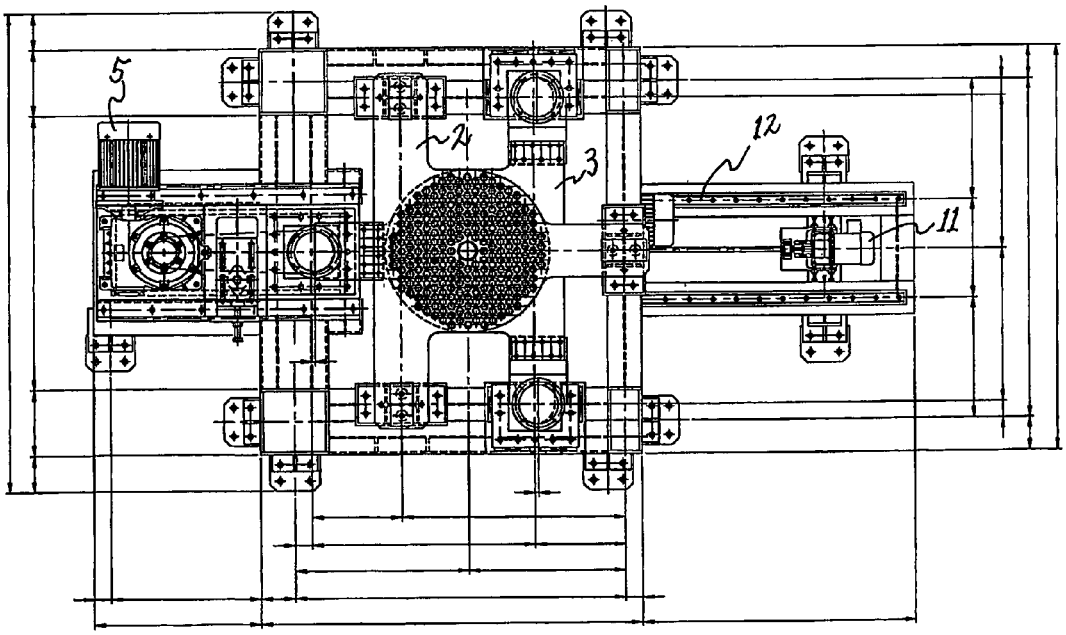
FIG. 2 is a plan view of the nano grinding mill of this invention.
Figure 3:
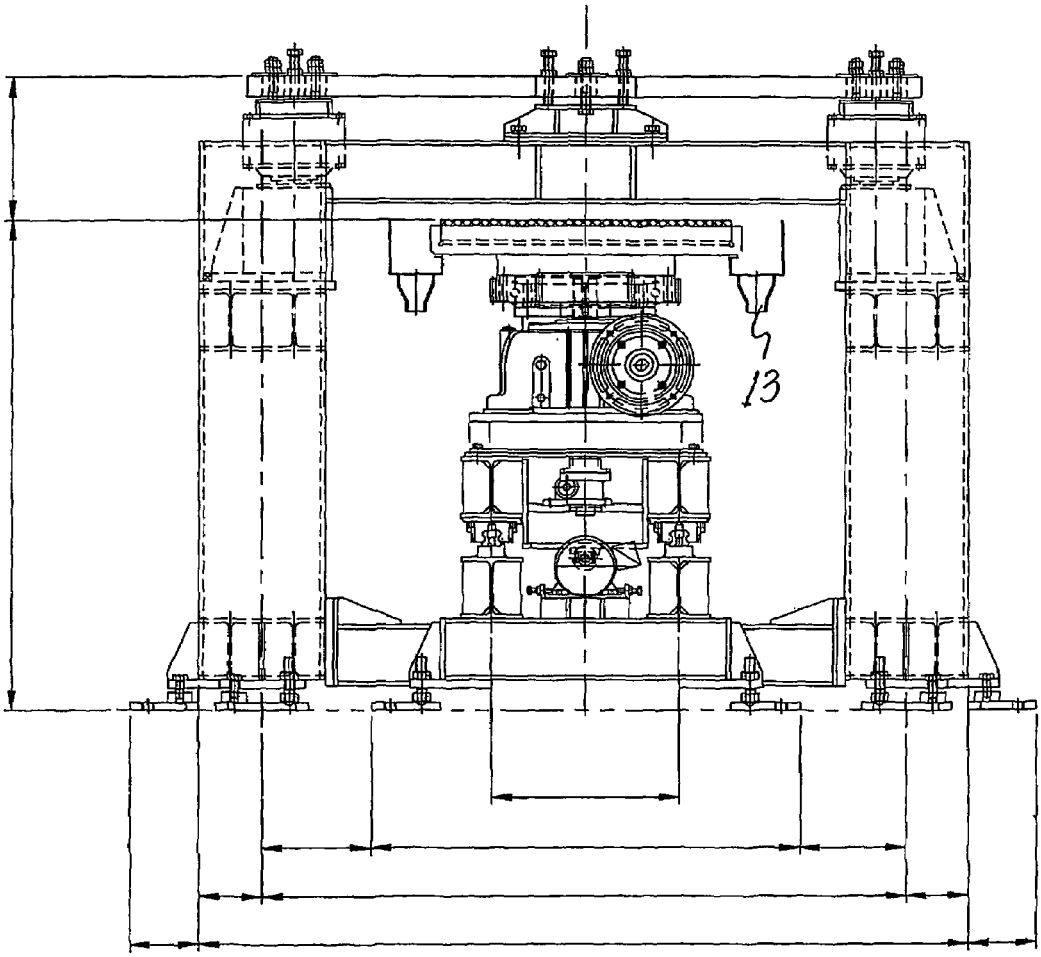
FIG. 3 is a side view of the nano grinding mill of this invention.

FIG. 3 is a side view of a nano grinding mill of this invention, wherein the particles flowing into the central portion of a lower turntable 25 are pulverized by means of a plurality of pressure grinding rods 4, while the lower turntable 25 is being rotated, and they are depressed to the outside out of the middle of a ceramic disc plate 7 by action of a centrifugal force, with a result of being dropped to a discharging outlet 13.

Figure 4:
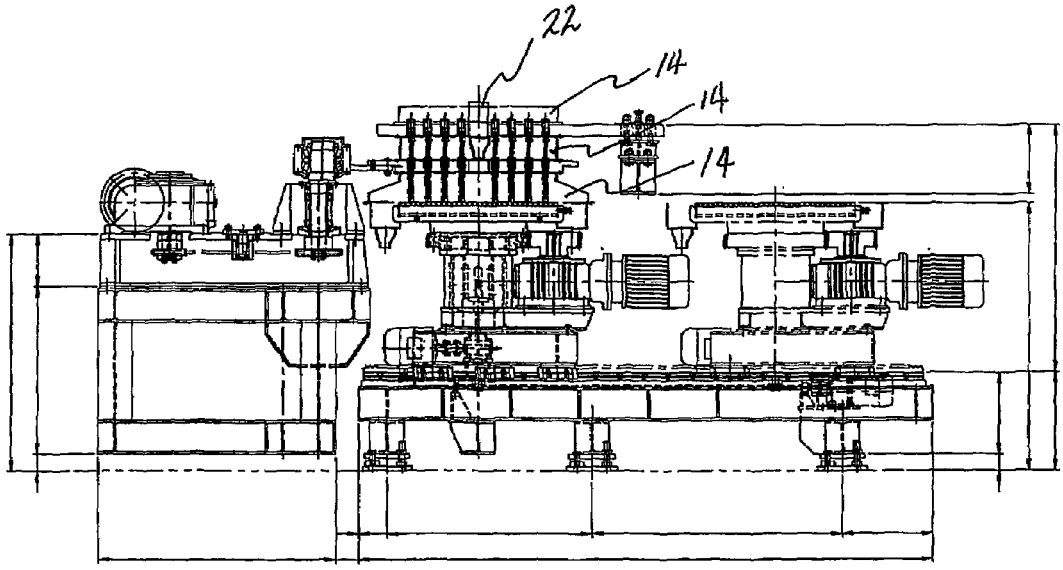
FIG. 4 is a front view of the mounting of a plurality of pressure grinding rods and the movement of the truck in the nano grinding mill of this invention.

FIG. 4 is a front view of the mounting of a plurality of pressure grinding rods and the movement of the truck in the nano grinding mill of this invention. In this figure, there is provided a material pouring inlet 22 in the middle of an upper plate 2, and the plurality of pressure grinding rods 4 are mounted to the upper plate 2 and an intermediate plate 3, respectively.

The lower turntable 25 that is shown by a dotted line is in a backward movement by means of a truck driving motor 11, for implementing its repairing or cleaning.

In addition, a dust cover 14 is provided for preventing the splash of the particles.

Figure 5:
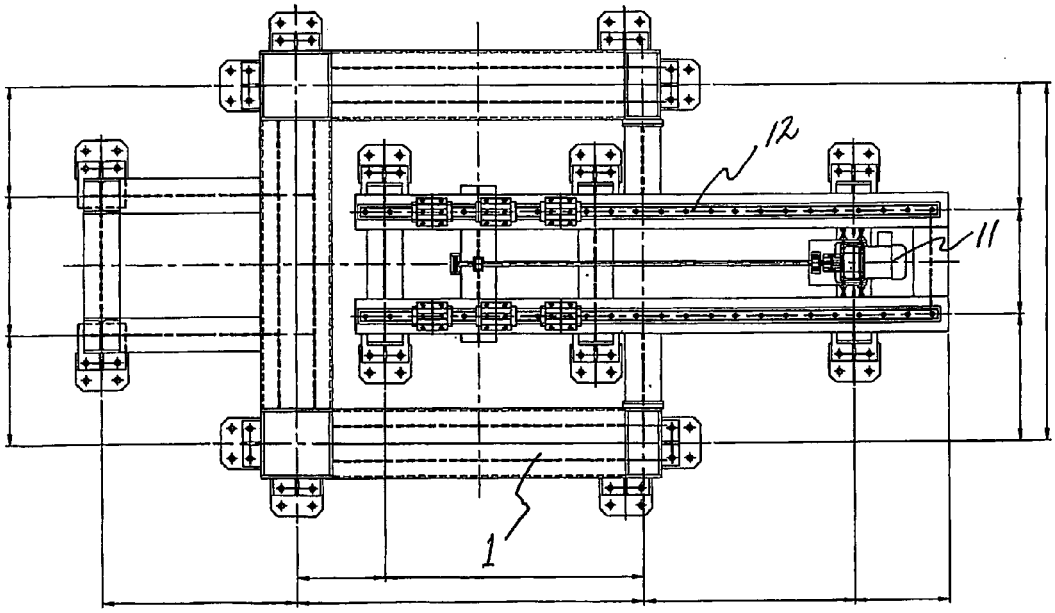
FIG. 5 is a plan view of the truck of the nano grinding mill of this invention.

FIG. 5 shows truck equipment that is comprised of a truck 10, the truck driving motor 11 and a rail 12, all of which serve to move the lower turntable 25 in forward and backward directions, such that the lower turntable 25 can be repaired or cleaned in an easy manner.

Figure 6:
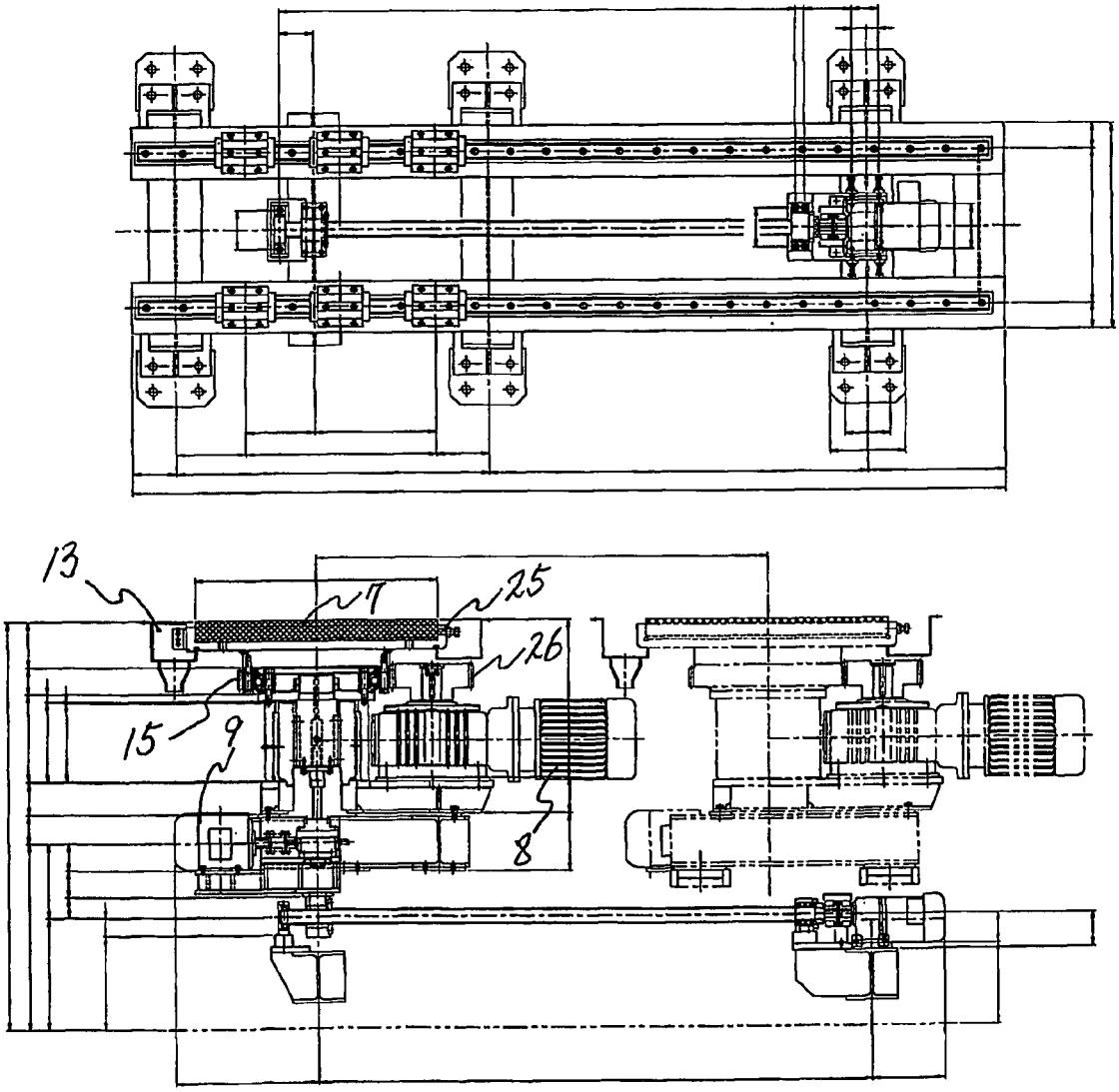
FIG. 6 is a front view of a lower turntable of the nano grinding mill of this invention.

FIG. 6 is a detailed view of the lower turntable 25.

The lower turntable 25 is formed with the insertion of the ceramic disc plate 7, a steel plate having high surface hardness, or another diamond-coated disc plate, and as a pinion gear 26 is rotated by means of a driving motor 8 thus to rotate an outer raceway gear 15, the lower turntable 25 becomes rotated.

An up and down motor 9 serves to adjust the force (pressure) applied to the plurality of pressure grinding rods.

Figure 7:
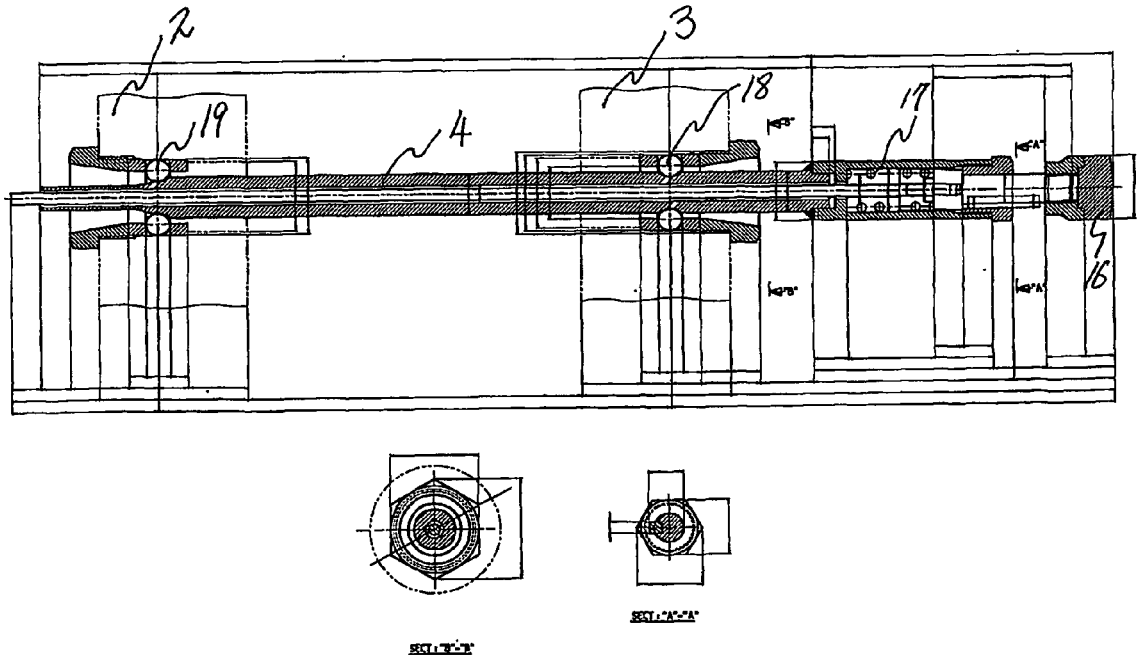
FIG. 7 is a detailed view of the pressure grinding rod of the nano grinding mill of this invention.

FIG. 7 is a detailed view of the pressure grinding rod 4.

In the figure, the top end portion of the pressure grinding rod 4 is fixed to the upper plate 2 by means of rubber rings 19.

At this time, the rubber rings 19 give flexibility when the pressure grinding rod 4 is moved. Furthermore, the middle portion of the pressure grinding rod 4 is coupled with the intermediate plate 3 on which self-aligning bearings or rubber rings 18 are provided, such that when the intermediate plate 3 conducts a circular motion by an eccentric interval 23 by means of an eccentric driving shaft 6, it can do the circular motion in smooth manner with the help of the self-aligning bearings or rubber rings 18.

The lower end portion of the pressure grinding rod 4 is coupled with the ceramic ball 16 for grinding the material to be ground and includes pressure springs 17 that are inserted in the interior thereof, the pressure springs 17 serving as a cylinder.

Figure 8:
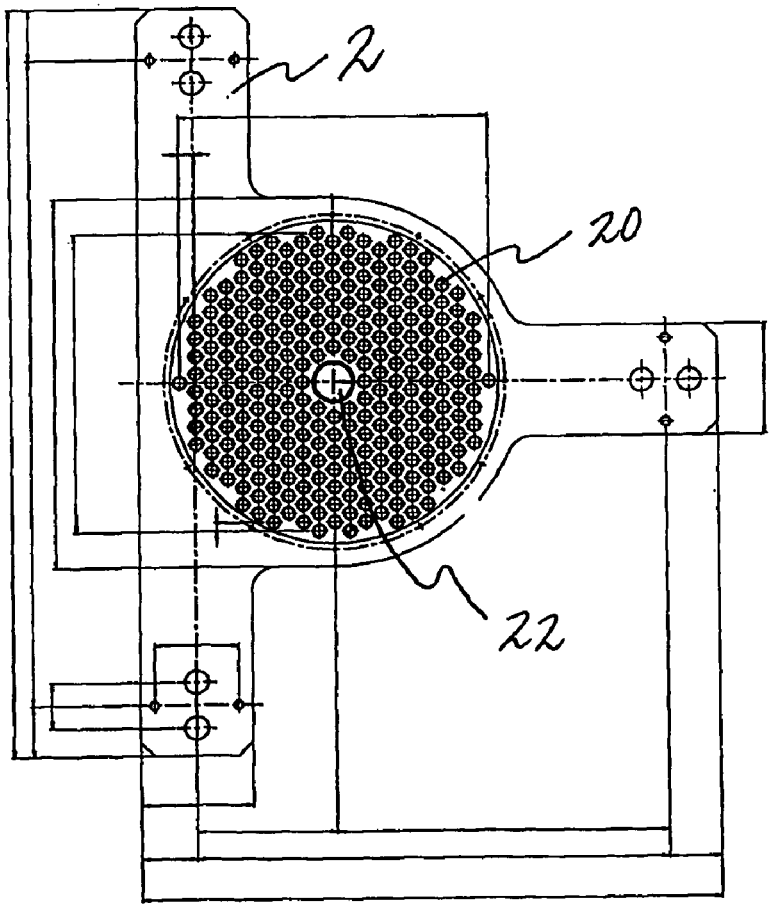
FIG. 8 is a plan view of an upper plate of the nano grinding mill of this invention.

FIG. 8 is a detailed view of the upper plate 2. The upper plate 2 is provided with the material pouring inlet 22 that is formed in the middle thereof and with a plurality of pressure rod insertion holes 20 that are arranged at predetermined intervals around the material pouring inlet 22. In this case, the number of pressure grinding rod insertion holes 20 is dependant upon the size of the upper fixing plate 2. That is, the preferred embodiment of the present invention is provided with several tens to several thousands of pressure grinding rod insertion holes 20.

Figure 9:
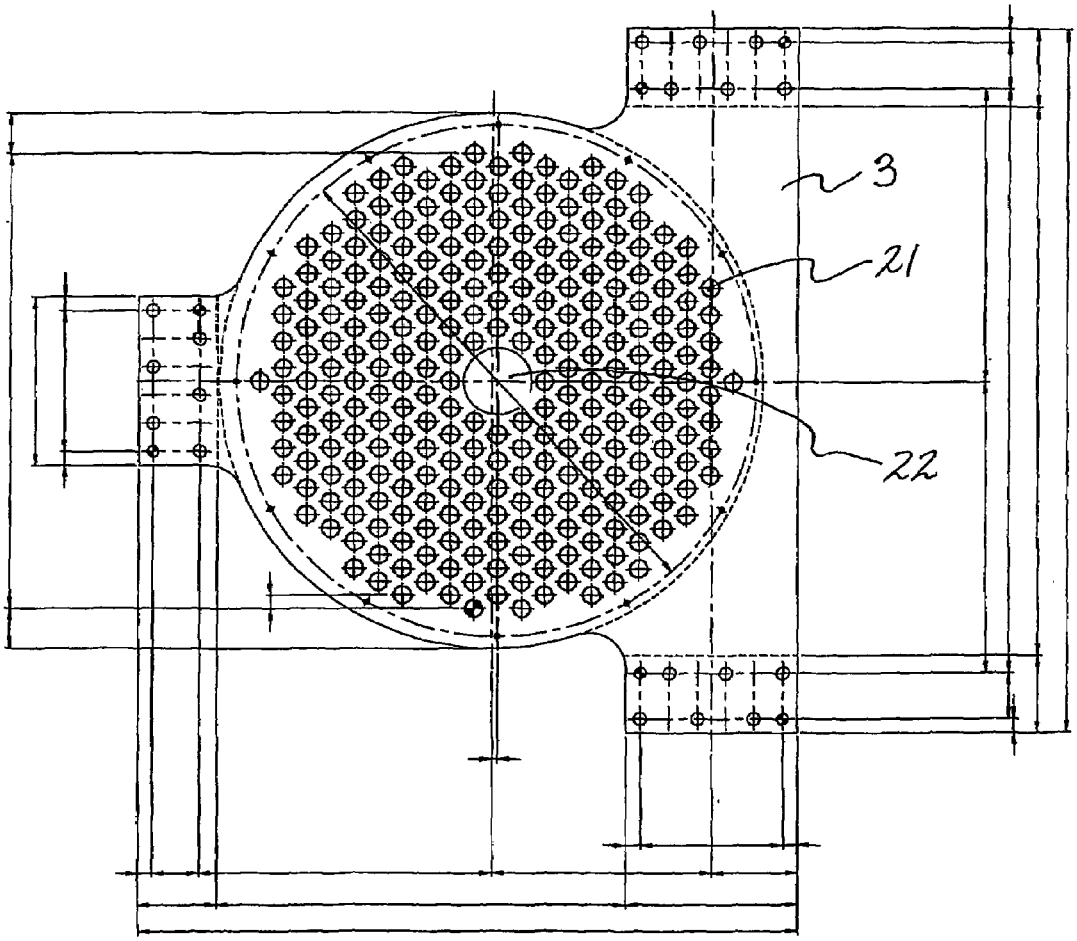
FIG. 9 is a plan view of an intermediate plate of the nano grinding mill of this invention.

FIG. 9 is a detailed view of the intermediate plate 3.

In the same manner as in the upper plate 2, the intermediate plate 3 is provided with the material pouring inlet 22 that is formed in the middle thereof and with the plurality of pressure grinding rod insertion holes 20 that are arranged at predetermined intervals around the material pouring inlet 22. In this case, the number of pressure grinding rod insertion holes 20 is dependant upon the size of the upper fixing plate 2. That is, the preferred embodiment of the present invention is provided with several tens to several thousands of pressure grinding rod insertion holes 20.

Figure 10:
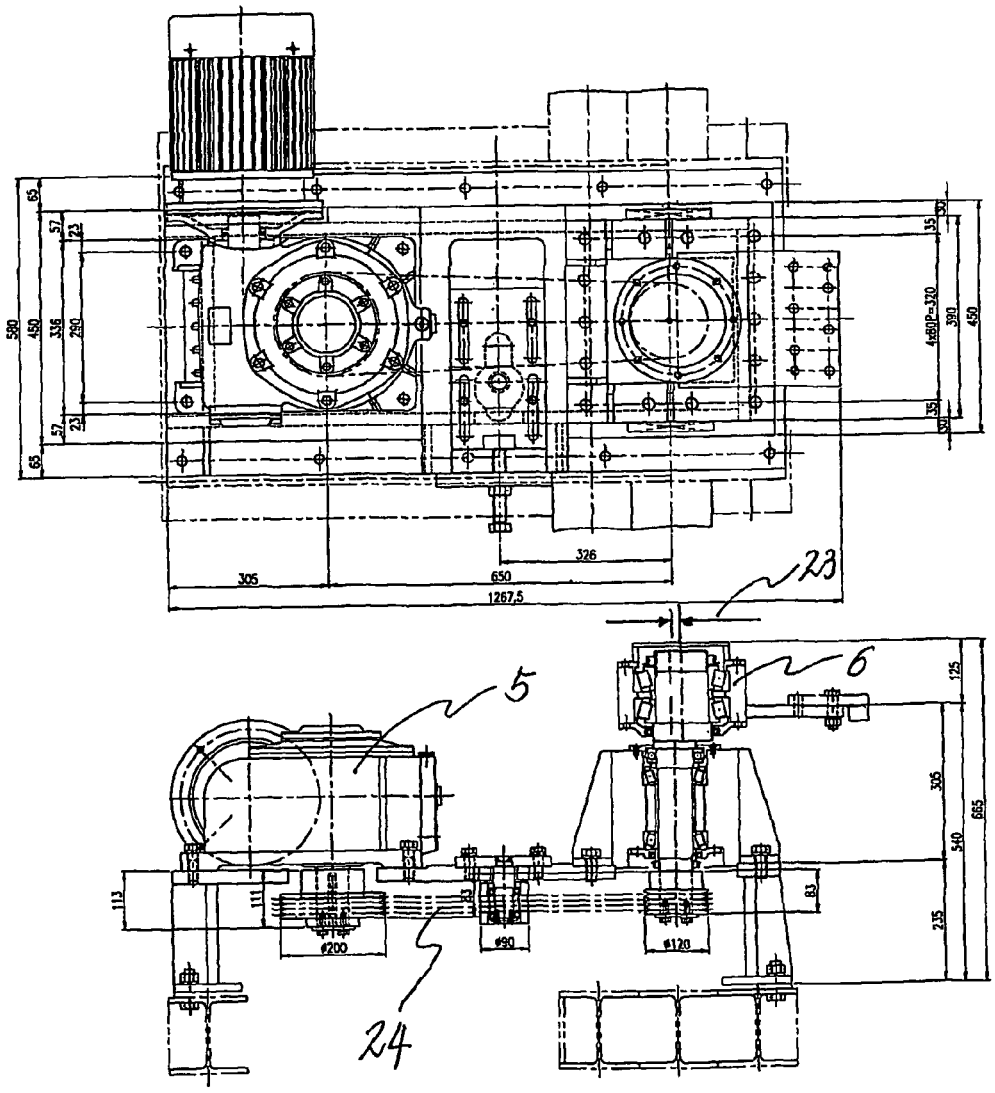
FIG. 10 is a detailed view of the driving shaft of the intermediate plate of this invention.

FIG. 10 is a detailed view of the driving shaft 6 of the intermediate plate 3 of this invention, wherein the driving shaft 6 includes an eccentric shaft that is covered by the eccentric interval 23, such that the eccentric shaft serves to enable the intermediate plate 3 to conduct an eccentric motion.

Figure 11:
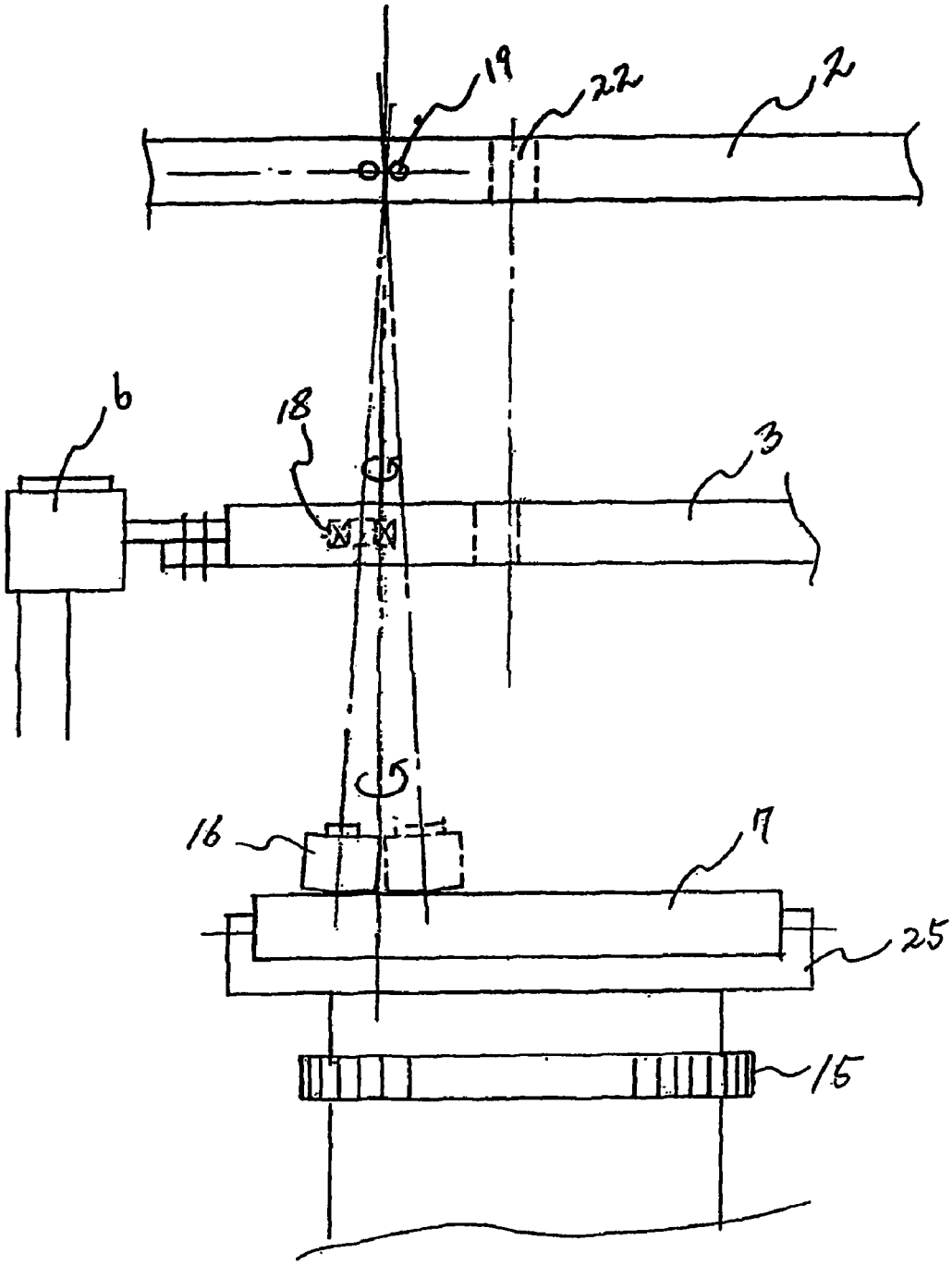
FIG. 11 is a plan view of the rotation of the pressure grinding rod of the nano grinding mill of this invention.
Figure 12:
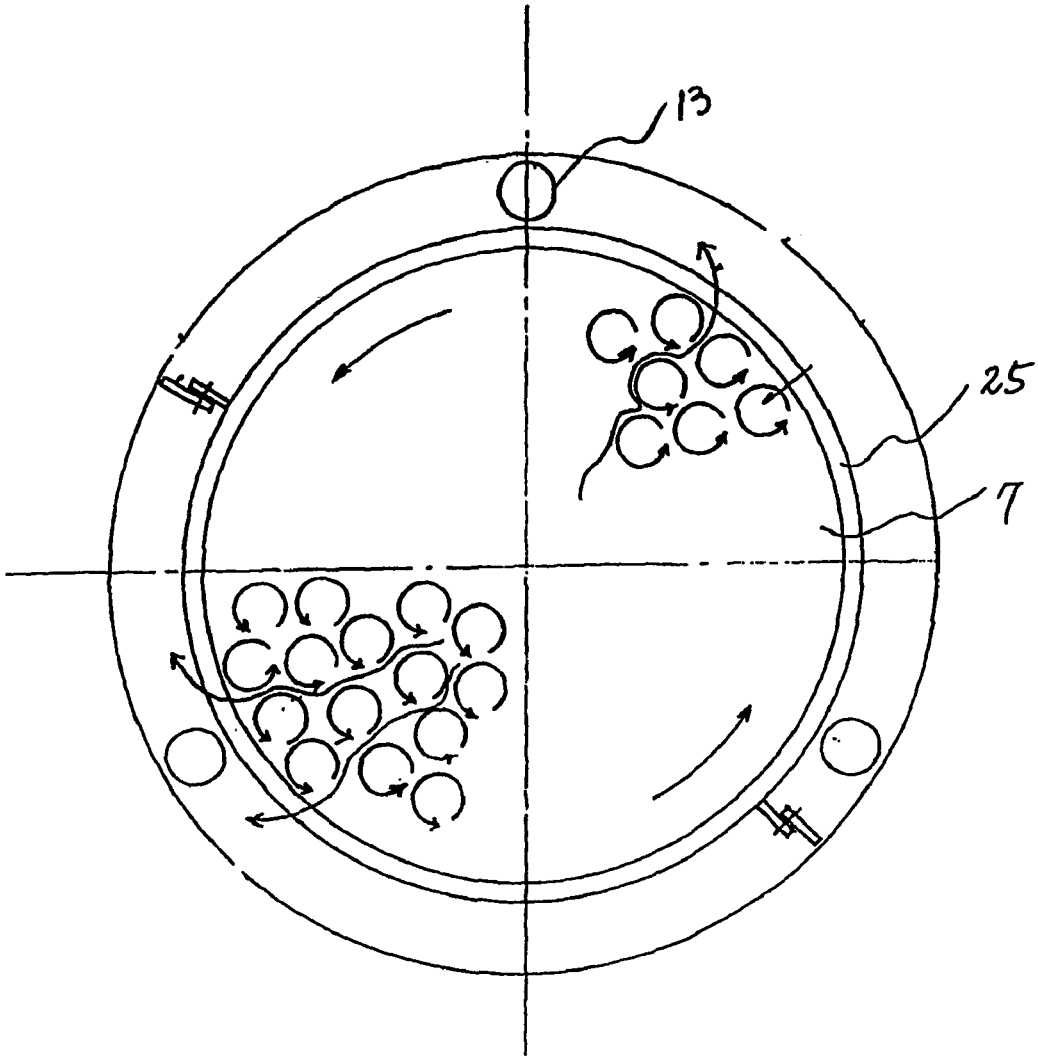
FIG. 12 is a schematic view of the motions of the pressure grinding rods and the materials being pushed to the outside.

FIG. 11 shows the rotation of the pressure grinding rod 4.

The top end portion of each pressure grinding rod 4 is fixed to the upper plate 2 by use of the rubber rings 19, and the middle portion thereof is held onto the intermediate plate 3 by use of the self-aligning bearings or the rubber rings 18.

When the eccentric driving shaft 6 starts to rotate, the several tens to several thousands of pressure grinding rods 4 conduct their individual circular motion on the ceramic disc plate 7 being rotated, such that the materials to be ground are pulverized to nano-sized fine particles.

At this time, it is possible that the upper fixing plate serves to conduct the eccentric circular motion and the intermediate plate serves to fix the pressure grinding rods. This does not give any influence to the motion mechanism of the pressure grinding rods. From the viewpoint of the grinding efficiency and maintenance of the grinding mill, however, it is not desirable to change their functions with each other.

INDUSTRIAL APPLICABILITY

As set forth in the foregoing, the present invention provides a nano grinding mill that has several tens to several thousands of pressure grinding rods arranged at predetermined intervals on a lower turntable, each conducing an individual eccentric rotation, thereby achieving a substantially high grinding efficiency and enabling the nano-sized fine particles to be obtained in great quantities in a dried manner. So, this allows the nano-sized fine particles to be provided to all variety of particles fields such as medicine, food, minerals and non-metal minerals, which results in the industrial development for all kinds of materials.

For example, when the materials for the medicine are ground to nano-sized fine particles, the effect of the medicine is given fast and a substantially small amount of medicine is needed. The nano grinding mill of this invention can extend its applicable range to various industrial fields such as paint that does not peel off well, high strength of engineering plastics, high functional cosmetics, semiconductors, aviation, and so on.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A nano grinding mill comprising: a lower turntable with a disc plate mounted on the lower portion thereof; and upper and intermediate plates disposed above the lower turntable, each of the upper and intermediate plates having several tens to several thousands of pressure grinding rods mounted thereon, the upper plate being adapted to fix the pressure grinding rods and the intermediate plate being adapted to eccentrically rotate the pressure grinding rods.

2. The nano grinding mill of claim 1, wherein the disc plate mounted on the lower turntable and a ball coupled to the end portion of each pressure grinding rod are replaceable with those made of a ceramic or diamond-coated material depending on the hardness of the material to be ground, so that grinding is conducted at the disc plate and the ball.

3. The nano grinding mill of claim 1, wherein each of the several tens to several thousands of pressure grinding rods comprises a spring for adjusting the pressure applied thereto depending on the hardness of the material to be ground.

* * * * *